US009967659B2

(12) United States Patent
Silva et al.

(10) Patent No.: US 9,967,659 B2
(45) Date of Patent: May 8, 2018

(54) LOW CAPACITANCE, SHIELDED, WATERTIGHT DEVICE INTERCONNECT

(71) Applicant: Raytheon Company, Waltham, MA (US)

(72) Inventors: Sarah J. Silva, Dartmouth, MA (US); Thomas J. Peirce, III, Westport, MA (US); Amir W. Habboosh, Somerset, MA (US); James Sturges, Tiverton, RI (US)

(73) Assignee: RAYTHEON COMPANY, Waltham, MA (US)

( * ) Notice: Subject to any disclaimer, the term of this patent is extended or adjusted under 35 U.S.C. 154(b) by 246 days.

(21) Appl. No.: 14/808,141

(22) Filed: Jul. 24, 2015

(65) Prior Publication Data

US 2017/0026743 A1 Jan. 26, 2017

(51) Int. Cl.

| | |
|---|---|
| ***H04R 1/44*** | (2006.01) |
| ***H04R 3/00*** | (2006.01) |
| ***H04R 29/00*** | (2006.01) |

(52) U.S. Cl.

CPC ..... *H04R 1/44* (2013.01); *H04R 3/007* (2013.01); *H04R 29/005* (2013.01)

(58) Field of Classification Search

CPC ..... G11K 11/00

See application file for complete search history.

(56) References Cited

U.S. PATENT DOCUMENTS

| | | | | |
|---|---|---|---|---|
| 2,601,300 A * | 6/1952 | Klein | B06B 1/0629 | 310/337 |
| 2,948,773 A * | 8/1960 | Hawes | H01B 17/58 | 16/2.2 |
| 3,939,463 A * | 2/1976 | Kelly | G01S 15/34 | 367/102 |
| 4,004,196 A * | 1/1977 | Doucet | H05K 3/222 | 361/784 |
| 4,093,935 A | 6/1978 | Ouellette | | |
| 4,638,468 A | 1/1987 | Francis | | |
| 4,745,584 A | 5/1988 | Andersen | | |
| 5,047,996 A | 9/1991 | Armiger | | |

(Continued)

FOREIGN PATENT DOCUMENTS

| | | |
|---|---|---|
| EP | 0615900 | 9/1994 |
| WO | 2009029520 A1 | 3/2009 |

OTHER PUBLICATIONS

PCT/US16/043254, ISR/WO, dated Nov. 7, 2016, 13 pages.

*Primary Examiner* — Hovhannes Baghdasaryan
(74) *Attorney, Agent, or Firm* — Cantor Colburn LLP

(57) ABSTRACT

A shielded electronic array is provided and includes a main plate having opposing first and second major surfaces, first and second electronic devices disposed on respective first portions of the first and second major surfaces, respectively, a noise-shielding plate disposed on a second portion of the second major surface, an insulated eyelet, which is press-fittable into the main and noise-shielding plates and first and second wiring components. The first wiring component extends along a main plate plane from the second electronic device. The second wiring component extends from the first wiring component to the first electronic device and has an exposed first portion and a second portion extending through the insulated eyelet.

17 Claims, 4 Drawing Sheets

(56) References Cited

U.S. PATENT DOCUMENTS

| | | | | |
|---|---|---|---|---|
| 5,481,436 | A * | 1/1996 | Werther | H05K 1/141 174/260 |
| 5,517,467 | A | 5/1996 | Fromont | |
| 5,571,033 | A * | 11/1996 | Kinsey, Jr. | H01R 13/41 439/444 |
| 5,994,166 | A * | 11/1999 | Akram | H05K 1/144 257/686 |
| 6,411,523 | B1 | 6/2002 | Roberson et al. | |
| 6,657,365 | B1 | 12/2003 | Ambs | |
| 6,683,819 | B1 | 1/2004 | Estaphan | |
| 6,950,062 | B1 | 9/2005 | Mather et al. | |
| 7,009,563 | B2 * | 3/2006 | Mori | H01Q 1/243 343/700 MS |
| 7,800,980 | B2 | 9/2010 | Busch | |
| 2003/0167850 | A1 * | 9/2003 | Ishiguro | G01C 9/06 73/718 |
| 2008/0157338 | A1 * | 7/2008 | Nakasato | H01L 23/3114 257/690 |

* cited by examiner 22
50
20
221
93
90
81
83
60
70
72, 704
80
71, 703
82
7031
415
41
61
62
210
414
410
411
23
412
220
30
310
21
P
24
40
31

50
53

52
51

LOW CAPACITANCE, SHIELDED, WATERTIGHT DEVICE INTERCONNECT

GOVERNMENT LICENSE RIGHTS

This invention was made with Government support under contract number N00024-14-C-6302 awarded by the U.S. Navy. The government has certain rights in the invention.

BACKGROUND

The present disclosure relates to a device interconnect and, more particularly, to a low capacitance, shielded, watertight device interconnect.

A hydrophone is a microphone designed to be used underwater for recording or listening to underwater sound. Most hydrophones are based on a piezoelectric transducer that generates electricity when subjected to a pressure change. Such piezoelectric materials or transducers can convert a sound signal into an electrical signal since sound is a pressure wave. A hydrophone can thus "listen" to sound in air.

Multiple hydrophones can be arranged in an array so that signals from a desired direction can be added while signals from other directions can be subtracted. The array may be aligned in one, two or more directions and may be steered or towed.

SUMMARY

According to one embodiment, a shielded electronic array is provided and includes a main plate having opposing first and second major surfaces, first and second electronic devices disposed on respective first portions of the first and second major surfaces, respectively, a noise-shielding plate disposed on a second portion of the second major surface, an insulated eyelet, which is press-fittable into the main and noise-shielding plates and first and second wiring components. The first wiring component extends along a main plate plane from the second electronic device. The second wiring component extends from the first wiring component to the first electronic device and has an exposed first portion and a second portion extending through the insulated eyelet.

According to another embodiment, a shielded electronic array is provided and includes a main plate having opposing first and second major surfaces, respective arrays of first and second electronic devices disposed on respective first portions of the first and second major surfaces, respectively, a noise-shielding plate disposed on a second portion of the second major surface, insulated eyelets, which are each press-fittable into the main and noise-shielding plates for each of the second electronic devices and first and second wiring components. The first wiring components respectively extend along a main plate plane from corresponding ones of the second electronic devices. The second wiring components respectively extend from corresponding ones of the first wiring components to corresponding ones of the first electronic devices and have exposed first portions and second portions extending through corresponding ones of the insulated eyelets.

According to another embodiment, a shielded electronic array is provided and includes a main plate having opposing first and second major surfaces, respective arrays of pre-amplifiers and sonar receive sensors disposed on respective first portions of the first and second major surfaces, respectively, a noise-shielding plate disposed on a second portion of the second major surface, insulated eyelets, which are each press-fittable into the main and noise-shielding plates for each of the sonar receive sensors and wiring. The wiring extends along a main plate plane from corresponding ones of the second electronic devices to corresponding ones of the first electronic devices and has exposed first portions and second portions extending hermetically through corresponding ones of the insulated eyelets.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
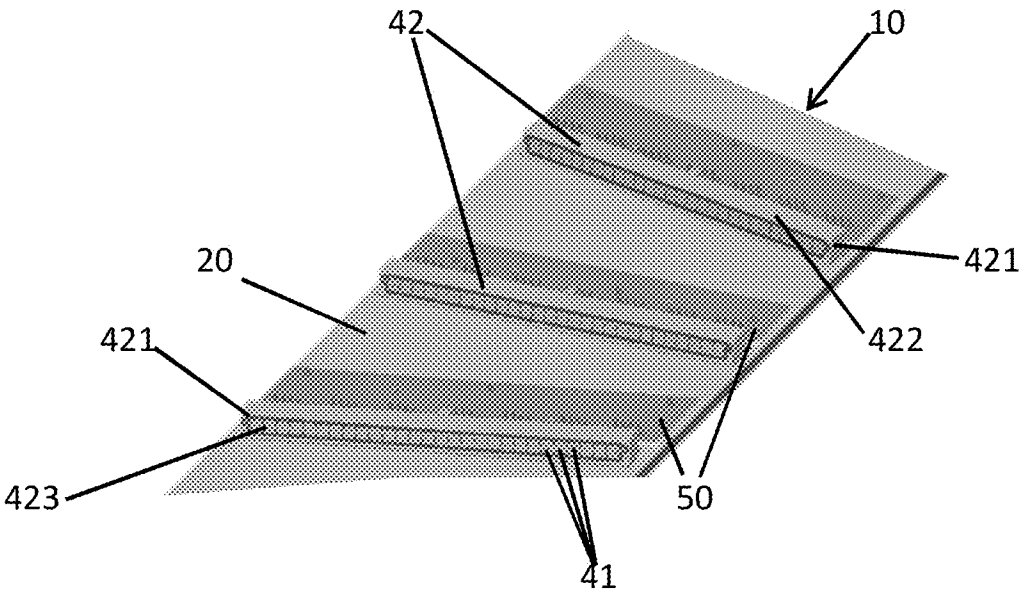
FIG. 1 is a perspective view of a low capacitance, shielded, watertight device interconnect in accordance with embodiments.

As will be described below, sonar arrays incorporate analog outboard preamplifier electronics on a single inboard printed wiring board (PWB). Such relocation of the preamplifier electronics requires a receive sensor to PWB interconnect exhibiting low capacitance (relative to the sensor) shielding that is capable of preventing an intrusion of an array encapsulant material, and also capable of providing a hermetically sealed assembly.

With reference to FIGS. 1-5, a shielded electronic array assembly 10 is provided and includes a main array mounting plate 20, an array of first electronic devices 30, an array of second electronic devices 40, a noise-shielding plate 50, insulated eyelets 60 and wiring 70.

Figures 2, 3A, 3B:
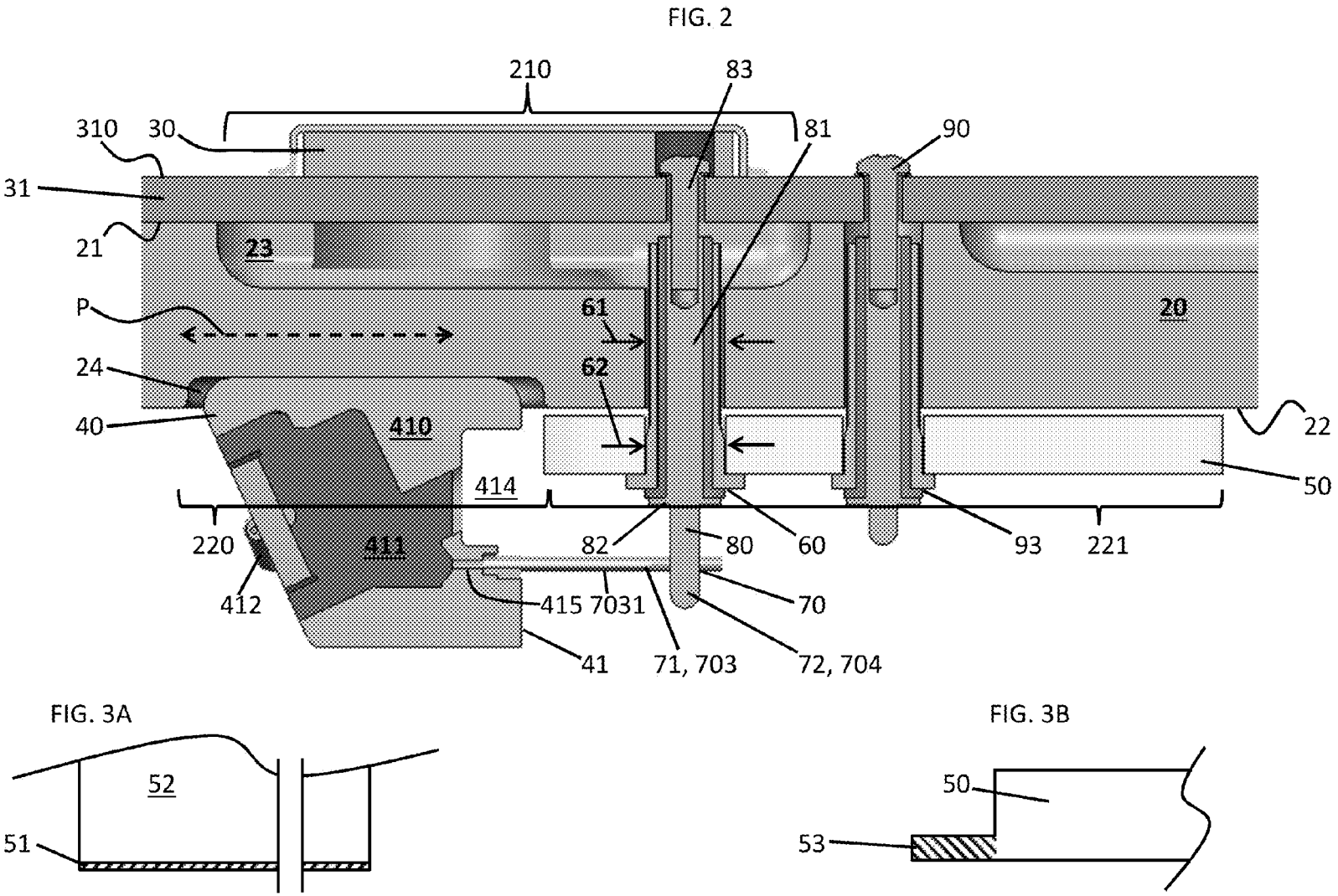
FIG. 2 is a side view of the low capacitance, shielded, watertight device interconnect of FIG. 1.
FIG. 3A is an enlarged side view of a noise-shielding plate in accordance with embodiments.
FIG. 3B is an enlarged side view of the noise-shielding plate in accordance with further embodiments.

The main array mounting plate 20 has a first major surface 21 and a second major surface 22, which is opposite the first major surface 21. The main array mounting plate 20 extends along a plane P and may be elongate in a longitudinal direction defined along the plane P. In addition, as shown in FIG. 2, the first major surface 21 has a plurality of first recesses 23 formed therein and the second major surface 22 has a plurality of second recesses 24 formed therein. The first recesses 23 are recessed into a body of the main array mounting plate 20 and may have rounded corners and sides. The second recesses 24 are recessed into the body of the main array mounting plate 20, in an opposite direction relative to the first recesses 23, and may have rounded corners and sides.

The first electronic devices 30 may be provided, for example, as pre-amplifier electronics and are operably disposed in or at locations corresponding to the first recesses 23 at first portions 210 of the first major surface 21. In accordance with embodiments, the first major surface 21 may be covered by a conductive or non-conductive plate element 31 with the first electronic devices 30 secured to an exterior surface 310 of the plate element 31. In these or other cases, the first electronic devices 30 may include electronic components 31 disposed to abut with the exterior surface 310 and lid elements 32, which extend about the electronic components 31 and may be coupled to the exterior surface 310 to secure the electronic components 31 in place.

Each of the second electronic devices 40 may be provided, for example, as a receive sensor assembly 41 that is operably disposed in or at a location corresponding to one of the second recesses 24 at first portions 220 of the second major surface 22. In accordance with embodiments, the receive sensor assembly 41 includes a housing element 410, which is formed to define an internal spatial region 411, a receive sensor 412 (such as, for example, a piezoelectric transducer) that is disposed and configured to perform sonar sensing functionalities and a filler material 413 that secures the receive sensor 412 in the internal spatial region 411. In accordance with further embodiments, the housing element 410 is adhered, cemented or otherwise secured within the one of the second recesses 24 and is formed to define a lateral recess 414 relative to a sidewall thereof and a connection aperture 415 within the lateral recess 414.

The noise-shielding plate 50 is disposed on a second portion 221 of the second major surface 22. The second portion 221 may be defined proximate to the above-described first portion 220 such that the noise-shielding plate 50 is correspondingly proximate to each corresponding one of the second electronic devices 40. The insulated eyelets 60 are each press-fittable into corresponding holes 61, 62 in the main array mounting plate 20 and the noise-shielding plate 50 for each of the second electronic devices 40. The wiring 70 is provided for each first and second electronic device 30 and 40 and extends along the plane P from the second electronic devices 40 to corresponding ones of the first electronic devices 30 and has exposed first wiring portions 71 and second wiring portions 72. The second wiring portions 72 extend hermetically through corresponding ones of the insulated eyelets 60.

As shown in FIG. 1, the second electronic devices 40 may be arranged in multiple groups of multiple devices. For example, where the second electronic devices 40 are receive sensor assemblies 41, the receive sensor assemblies 41 may be provided in groups that are encompassed within a single elongate housing 42 that has end walls 421 and a lid 422 as well as elongate apertures 423 running along the length of the lid 422 on either side of the housing 42. The elongate apertures 423 permit signals to reach the receive sensors 412 (see FIG. 2) in each receive sensor assembly 41 and to permit the wiring 70 to access the connection apertures 415 as will be discussed below. In accordance with embodiments, the receive sensor assemblies 41 may be provided in groups that are further sub-divided into proximal sub-groups of sensor assemblies 41. In such cases, the distances between adjacent proximal sub-groups exceed the distances between individual sensor assemblies 41 in each proximal sub-group.

In accordance with further embodiments, for a given shielded electronic array assembly 10, multiple housings 42 that each encompass multiple receive sensor assemblies 41 in multiple proximal sub-groups may be provided. In such cases, as shown in FIG. 1, a central housing 42 would run across a width of the main array mounting plate 20 in a direction substantially perpendicular with the longitudinal axis of the main array mounting plate 20. The housings 42 adjacent to the central housing would run at relatively small opposite obtuse angles relative to the longitudinal axis and any outer-most housings 42 would run at relatively and increasingly large opposite obtuse angles relative to the longitudinal axis. Thus, in some cases, the multiple housings 42 may assume a fan-like configuration across the second major surface 22 although it is to be understood that other configurations are possible.

In these or other embodiments, multiple noise-shielding plates 50 are respectively disposed on the second major surface 22 proximate to corresponding ones of the multiple housings 42. That is, a central noise-shielding plate 50 runs across the width of the main array mounting plate 20 next to the central housing 42, noise-shielding plates 50 run at relatively small obtuse angles relative to the longitudinal axis next to the housings 42 adjacent to the central housing 42 and any outer-most noise-shielding plates 50 run at relatively and increasingly large obtuse angles relative to the longitudinal axis next to the outer-most housings 42. Thus, in some cases, the multiple noise-shielding plates 50 may assume a fan-like configuration across the second major surface 22 although it is to be understood once again that other configurations are possible.

Figure 1A:
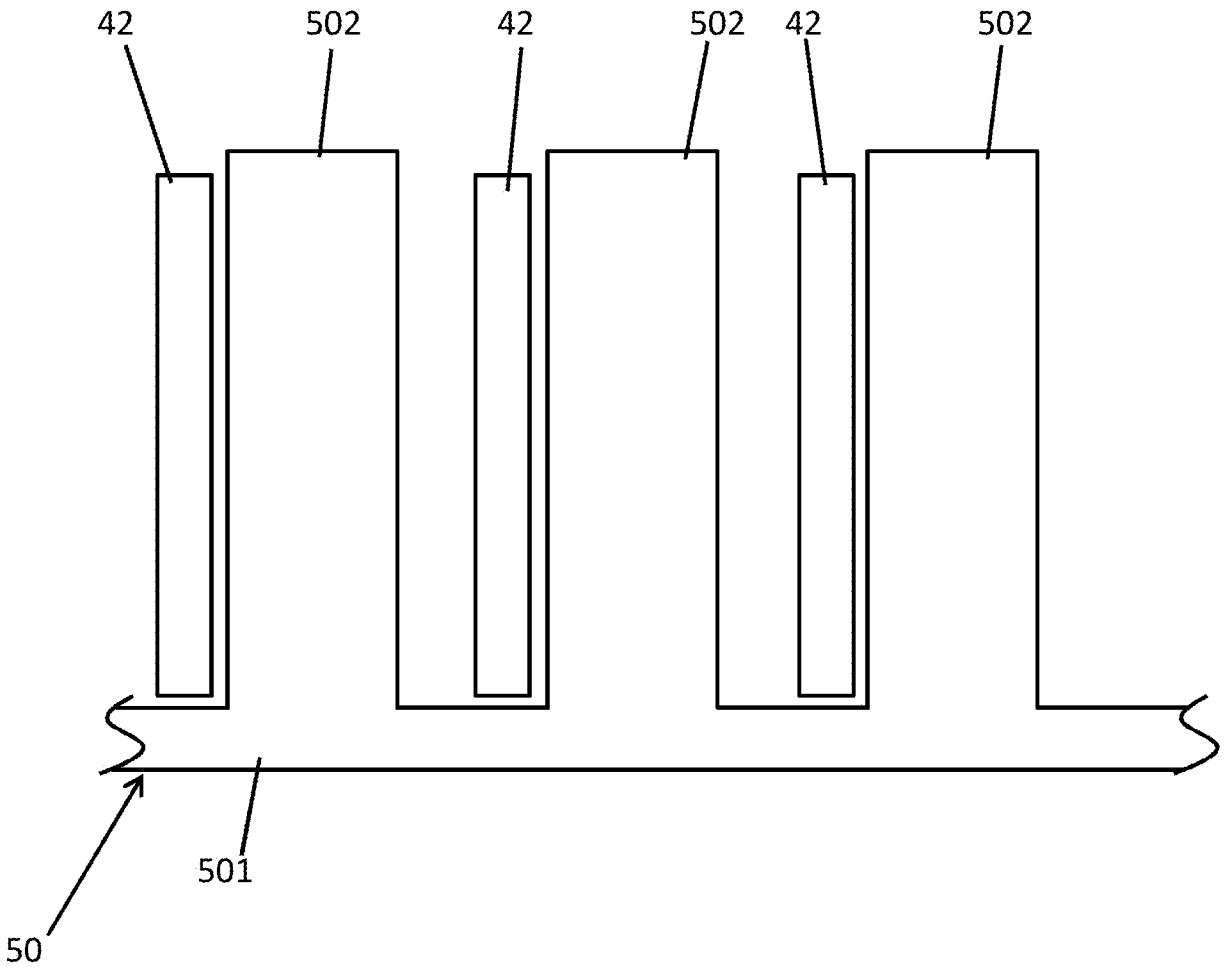
FIG. 1A is a top-down view of a low capacitance, shielded, watertight device interconnect in accordance with alternative embodiments.

Although the multiple noise-shielding plates 50 are drawn in FIGS. 1 and 2 as corresponding in number, position and orientation with the multiple housings 42, this is not required. In fact, embodiments exist in which no such correspondence exists such that, for example, a single house shielding plate 50 may be provided for all of the multiple housings 42. With reference to FIG. 1A, in this or other cases, the single noise shielding plate 50 may be formed as a spine portion 501 from which multiple plate portions 502 extend in similar directions.

Each of the multiple housings 42 may be rectangular in cross-section. That is, the end walls 421 for each housing 42 are substantially parallel with each other and perpendicular with respect to a longitudinal axis of each housing 42. By contrast, each of the noise-shielding plates 50 may have a varying cross-sectional shape based on its respective position on the second major surface 22. That is, the central noise-shielding plate 50 may be rectangular, the outer-most noise shielding plates 50 may be severe parallelograms and the other noise-shielding plates 50 may be shallow parallelograms. In this way, near- and far-side edges of the noise-shielding plates 50 are parallel with their corresponding housing 42 but the longitudinal end edges of the noise-shielding plates 50 run along corresponding edges of the main array mounting plate 20.

Figure 5:
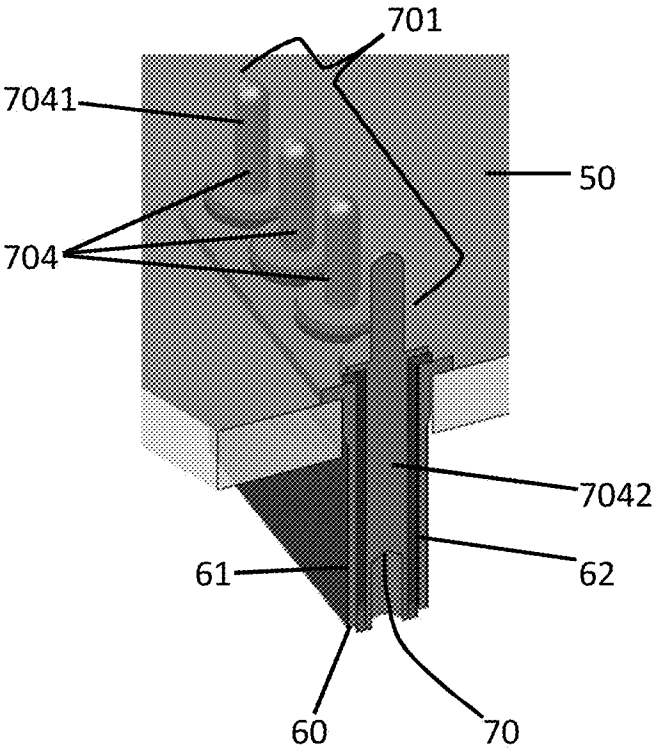
FIG. 5 is an enlarged perspective view of some of the components of FIG. 4.
Figure 4:
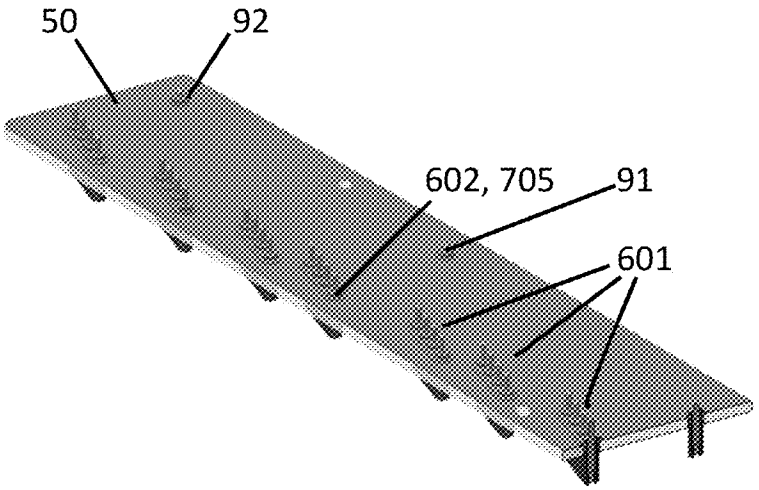
FIG. 4 is a perspective view of components of the low capacitance, shielded, watertight device interconnect of FIGS. 1 and 2.

As shown in FIGS. 4 and 5, for each of the multiple noise-shielding plates 50, the insulated eyelets 60 and the corresponding wiring 70 are provided in groups with multiple proximal sub-groups 601 of insulated eyelets 60 and multiple proximal sub-groups 701 of wiring 70. Within each of the multiple proximal sub-groups 601, the member insulated eyelets 60 are arranged in a staggered formation 602 that is angled away from the corresponding housing 42 with increasing distance along a width-wise direction of the main array mounting plate 20. Thus, the "first" member insulated eyelet 60 in a proximal sub-group 601 is closest to the corresponding housing 42 and the "last" member insulated eyelet 60 in the proximal sub-group 601 is furthest from the corresponding housing 42.

With reference back to FIG. 2, the wiring 70 for each second electronic device 40 includes a first wiring component 703 (all of the first wiring components 703 cooperatively form parts of the above mentioned first wiring portions 71) and a second wiring component 704 (all of the second wiring components 704 cooperatively form the above mentioned second wiring portions 72). The first wiring components 703 may be coated with a dielectric coating 7031 and respectively extend along the plane P from a corresponding one of the second electronic devices 40. More particularly, each first wiring component 703 extends along the plane P and may be electrically communicative with the corresponding receive sensor 412 via the corresponding connection aperture 415.

The second wiring components 704 respectively extend from distal ends of corresponding ones of the first wiring components 703 to corresponding ones of the first electronic devices 30. As shown in FIG. 5, the second wiring components 704 each have an exposed first portion 7041 and a second portion 7042. The second portion 7042 extends through a corresponding one of the insulated eyelets 60.

Thus, returning to the illustrated embodiments of FIGS. 4 and 5, it may be seen that while the first wiring components 703 for each noise-shielding plate 50 are coplanar and parallel, the second wiring components 704 for each noise-shielding plate 50 are arranged in the multiple proximal sub-groups 701. As such, within each of the multiple proximal sub-groups 701, the member second wiring components 704 are arranged in a staggered formation 705 that is angled away from the corresponding housing 42 with increasing distance along a width-wise direction of the main array mounting plate 20. Thus, the "first" member second wiring component 704 in a proximal sub-group 701 is closest to the corresponding housing 42 and the "last" member second wiring component 704 in the proximal sub-group 701 is furthest from the corresponding housing 42.

As shown in FIG. 2, each second wiring component 704 includes a head portion 80, which acts as the exposed first portion 7041, a main portion 81 and a flange 82. The flange 82 is integrally interposed between the head portion 80 and the main portion 81. The main portion 81 acts as the second portion 7042 and extends through the noise-shielding plate 50 and the main array mounting plate 20 to be receptive of screw element 83, which is coupled to and electronically communicative with the first electronic device 30.

As shown in FIG. 5, the insulated eyelet 60 includes a conductive layer 61 and a non-conductive layer 62. The conductive layer 61 may be formed of copper, for example, and is generally disposed about the main portion 81 (i.e., the second portion 7042) and includes a flange that abuts an exterior surface of the noise-shielding plate 50. The non-conductive layer 62 may be formed of Teflon™, for example, and is generally interposed between the conductive layer 61 and the main portion 81 (i.e., the second portion 7042). The non-conductive layer 62 may also include a flange interposed between the flange of the conductive layer 61 and the flange 82. With this construction, each of the insulated eyelets 60 forms a hermetic seal around the corresponding second wiring component 704.

During operation of the shielded electronic array assembly 10, noise is generated by the main array mounting plate 20 resulting from at least the operation of the first and second electronic devices 30 and 40. The respective sections of the second wiring components 702 extending through the main array mounting plate 20 are shielded from the noise by the corresponding sections of the insulated eyelets 60. The respective sections of the second wiring components 702 extending through the noise-shielding plate 50 are shielded from the noise by the noise-shielding plate 50 and the corresponding sections of the insulated eyelets 60. The first wiring components 703 are shielded from the noise by the noise-shielding plate 50.

To this end, with particular reference to FIGS. 3A and 3B, the noise-shielding plate 50 may include a conductive layer 51, which may be formed of copper or another similar material, and a non-conductive layer 52, which is substantially thicker than the conductive layer 51 (see FIG. 3A). In addition, the noise-shielding plate 50 may include a flange 53 that extends into the lateral recesses 414 of the second electronic devices 40. This flange 53 serves to shield the section of the first wiring components 703 from noise emanating from the main array mounting plate 20 proximate to the second electronic components 40.

In accordance with additional embodiments and, as shown in FIGS. 1, 2 and 4, the shielded electronic array assembly 10 may include third wiring 90. For each noise-shielding plate 50, the third wiring 90 includes a central wiring component 91 and exterior wiring components 92. The central wiring component 91 may be provided as a shield return grounding pin and the exterior wiring components 92 may be provided as common bus wiring. The central wiring component 91 and the exterior wiring components 92 are all disposed to include exposed portions and portions that run through the main array mounting plate 20 and the noise-shielding plate 50. Additional insulated eyelets 93 are provided to hermetically seal and electrically insulate the portions of the he central wiring component 91 and the exterior wiring components 92 that run through the main array mounting plate 20 and the noise-shielding plate 50.

With the above described configuration, the shielded electronic array assembly 10 allows for removal of a circuit card assembly (CCA) without a corresponding removal of encapsulant, saves significant labor costs during rework, allows for consistent wire lengths from each device to its respective connection on the pre-amplifier board, removes some calibration requirements and allows for minimization of capacitance between devices (very low capacitance) and pre-amplifiers. The shielded electronic array assembly 10 also provides for electro-magnetic interference (EMI) shielding with improved system noise immunity and radiation emission.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A shielded electronic array, comprising:

a main plate having opposing first and second major surfaces;

first and second electronic devices disposed on respective first portions of the first and second major surfaces, respectively;

a second plate disposed on a second portion of the second major surface;

an insulated eyelet, which is press-fittable into the main and second plates;

a first wiring component extending along a main plate plane from the second electronic device at a distance from the second major surface; and a second wiring component extending from the first wiring component to the first electronic device and having an exposed first portion extending from the first wiring component to an entry of the insulated eyelet and a second portion extending from an end of the exposed first portion through the insulated eyelet, wherein the second plate comprises a flange extending into a recess of the second electronic device.

2. The shielded electronic array according to claim 1, wherein the main plate comprises an array mounting plate.

3. The shielded electronic array according to claim 1, wherein the respective first portions of the first and second major surfaces each define recesses in which the first and second electronic devices are affixed.

4. The shielded electronic array according to claim 1, wherein the first electronic device comprises a pre-amplifier and the second electronic device comprises a sonar receive sensor.

5. The shielded electronic array according to claim 1, wherein the second plate comprises a non-conductive layer and a conductive, shielding layer, which is substantially thinner than the non-conductive layer.

6. The shielded electronic array according to claim 1, wherein the insulated eyelet comprises:

a conductive layer disposed about the second portion and a third portion of the second wiring component; and a non-conductive layer interposed between the conductive layer and the second and third portions of the second wiring component to form a hermetic seal around the second wiring component.

7. The shielded electronic array according to claim 1, wherein the exposed first portion and the second portion of the second wiring component extend perpendicularly with respect to the main plate plane.

8. A shielded electronic array, comprising:

a main plate having opposing first and second major surfaces;

respective arrays of first and second electronic devices disposed on respective first portions of the first and second major surfaces, respectively;

a second plate disposed on a second portion of the second major surface;

insulated eyelets, which are each press-fittable into the main and second plates for each of the second electronic devices, and first wiring components respectively extending along a main plate plane from corresponding ones of the second electronic devices at distances from the second major surface; and second wiring components respectively extending from corresponding ones of the first wiring components to corresponding ones of the first electronic devices and having exposed first portions extending from the first wiring components to respective entries of the insulated eyelets and second portions extending from respective ends of the exposed first portions through corresponding ones of the insulated eyelets, wherein the second plate comprises a flange extending into recesses of the second electronic devices.

9. The shielded electronic array according to claim 8, wherein the main plate comprises an array mounting plate.

10. The shielded electronic array according to claim 8, wherein the respective first portions of the first and second major surfaces each define recesses in which the first and second electronic devices are affixed.

11. The shielded electronic array according to claim 8, wherein the first electronic devices comprise pre-amplifiers and the second electronic devices comprise sonar receive sensors.

12. The shielded electronic array according to claim 8, wherein the array of the second electronic devices and the second plate are obtusely angled with respect to the main plate.

13. The shielded electronic array according to claim 12, wherein the array of the second electronic devices comprises a single, elongate housing.

14. The shielded electronic array according to claim 8, wherein the insulated eyelets and the second wiring components are arranged in staggered sub-groups and the first wiring components are substantially co-planar.

15. The shielded electronic array according to claim 8, wherein the second plate comprises a non-conductive layer and a conductive, shielding layer, which is substantially thinner than the non-conductive layer.

16. The shielded electronic array according to claim 8, wherein the insulated eyelets each comprise:

a conductive layer disposed about the second portions of the corresponding ones of the second wiring components; and a non-conductive layer interposed between the conductive layer and the second portions of the corresponding ones of the second wiring components to form hermetic seals around the corresponding ones of the second wiring components.

17. The shielded electronic array according to claim 8, wherein the exposed first portions and the second portions of the second wiring components extend perpendicularly with respect to the main plate plane.

* * * * *